US008120627B2

(12) United States Patent
Belik et al.

(10) Patent No.: US 8,120,627 B2
(45) Date of Patent: Feb. 21, 2012

(54) REDISTRIBUTION OF N-PRIMARY COLOR INPUT SIGNALS INTO N-PRIMARY COLOR OUTPUT SIGNALS

(75) Inventors: Oleg Belik, Eindhoven (NL); Gerben Johan Hekstra, Eindhoven (NL); Erno Hermanus Antonius Langendijk, Eindhoven (NL); Michiel Adriaanszoon Klompenhouwer, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 870 days.

(21) Appl. No.: 11/911,583

(22) PCT Filed: Apr. 13, 2006

(86) PCT No.: PCT/IB2006/051143

§ 371 (c)(1),
(2), (4) Date: Oct. 15, 2007

(87) PCT Pub. No.: WO2006/111894

PCT Pub. Date: Oct. 26, 2006

(65) Prior Publication Data

US 2008/0225056 A1 Sep. 18, 2008

(30) Foreign Application Priority Data

Apr. 21, 2005 (EP) ..... 05103235
Aug. 9, 2005 (EP) ..... 05107310

(51) Int. Cl.
*G09G 5/02* (2006.01)

(52) U.S. Cl. ..... 345/690; 345/603; 345/600

(58) Field of Classification Search ..... 345/603–604, 345/609, 690–694
See application file for complete search history.

(56) References Cited

U.S. PATENT DOCUMENTS 6,724,934 B1 * 4/2004 Lee et al. ..... 382/167
7,277,075 B1 * 10/2007 Hirano et al. ..... 345/89
7,728,846 B2 * 6/2010 Higgins et al. ..... 345/600
2005/0031199 A1 2/2005 Ben-Chorin et al.
2005/0099426 A1 5/2005 Primerano et al.

FOREIGN PATENT DOCUMENTS

WO WO2006106457 A1 10/2006

OTHER PUBLICATIONS

Wen, S.: "Design of Relative Primary Luminances for Four-Primary Displays"; Displays [Online], vol. 26, No. 4-5, Jul. 26, 2005, pp. 171-176.

* cited by examiner

*Primary Examiner* — Alexander Eisen
*Assistant Examiner* — Robin Mishler

(57) ABSTRACT

A method of redistributing an N-primary color input signal (IS) having a particular number≧4 (N) of input components (I1, . . . , IN) into N-primary color output signal (OS) having the particular number (N) of output components (P1, . . . , PN) under a constraint (CON2). The method comprises defining (MPRC) three functions (F1, F2, F3) representing three (P1, P2, P3) of the output components (P1, . . . , PN) as a function of the remaining N-3 output components (P4, . . . , PN). Substituting (MPRC) the values of the input components (I1, . . . , IN) into the three functions (F1, F2, F3) to determine unknown coefficients (P1', P2', P3') of the three functions (F1, F2, F3). And, determining (MPRC) optimal values of the output components (P1, . . . , PN) by applying the constraint (CON2) to the three functions (F1, F2, F3).

14 Claims, 4 Drawing Sheets

Figure 1:
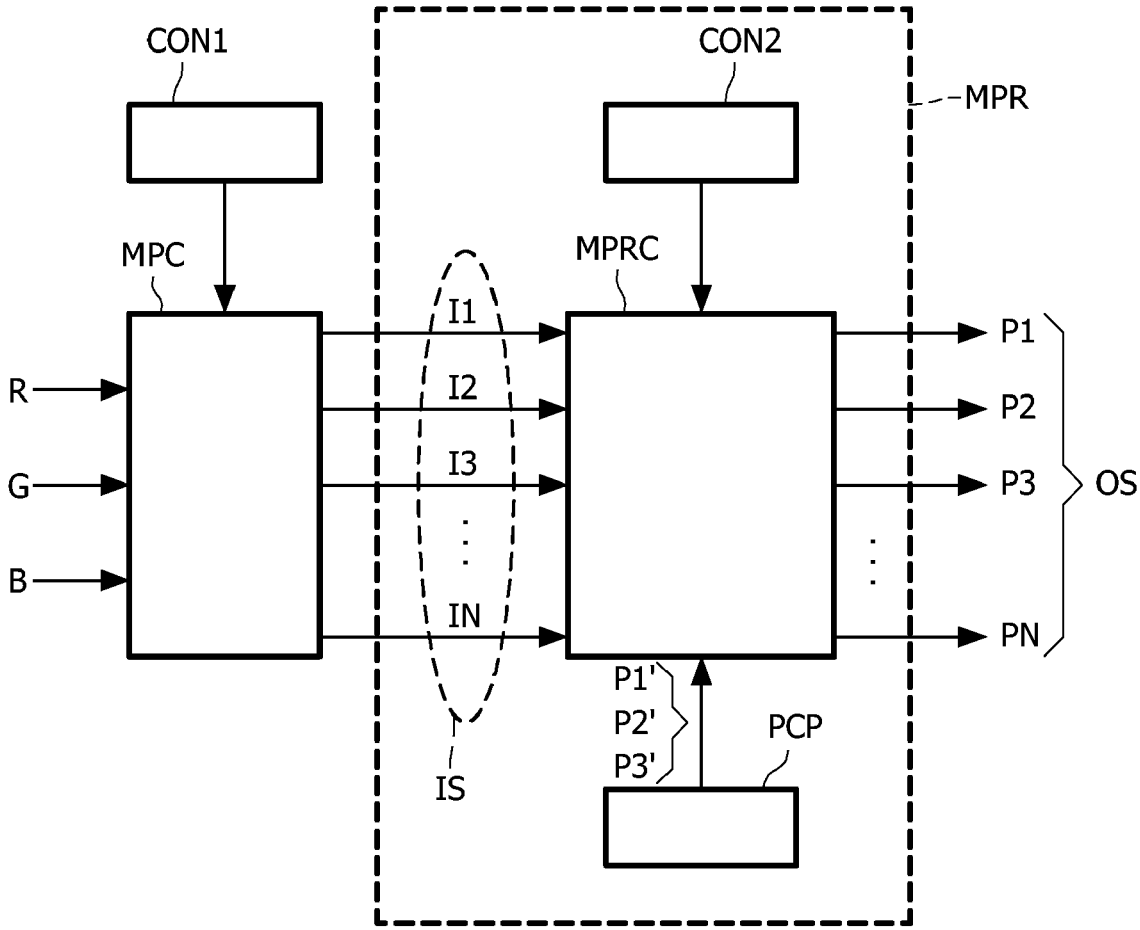

REDISTRIBUTION OF N-PRIMARY COLOR INPUT SIGNALS INTO N-PRIMARY COLOR OUTPUT SIGNALS

The invention relates to a method of redistributing an N-primary color input signal into an N-primary color output signal. The invention further relates to a computer program product, a system for redistributing the N-primary color input signal into the N-primary color output signal, a display apparatus comprising the system, a camera comprising the system, and a portable device comprising the display apparatus.

Current displays have three differently colored sub-pixels which usually have the three primary colors R (red), G (green), and B (blue). These displays are driven by three input color signals which for a display with RGB sub-pixels preferably are RGB signals. The input color signals may be any other related triplet of signals, such as for example, YUV signals. However, these YUV signals have to be processed to obtain RGB drive signals for the RGB sub-pixels. Typically, these displays with three differently colored sub-pixels have a relatively small color gamut.

Displays with four sub-pixels which have different colors provide a wider color gamut if the fourth sub-pixel produces a color outside of the color gamut defined by the colors of the other three sub-pixels. Alternatively, the fourth sub-pixel may produce a color inside the color gamut of the other three sub-pixels. The fourth sub-pixel may produce white light. Displays which have four sub-pixels are also referred to as four-primary displays. A display which has sub-pixels which illuminate R (red), G (green), B (blue), and W (white) light are generally referred to as RGBW displays.

More in general, displays which have $N \geqq 4$ differently colored sub-pixels are referred to as multi-primary displays. The N drive signals for the N primary colors of the sub-pixels are calculated from the three input color signals by solving a set of equations which define the relation between the N drive signals and the three input signals. Because only three equations are available while N unknown drive signals have to be determined, usually many solutions are possible. Present multi-primary conversion algorithms, which convert the three input color signals into the N drive signals by selecting a solution out of the many possible solutions, are quite inflexible. Consequently, for a particular application, a non-optimal solution out of the many possible solutions may be selected.

It is an object of the invention to provide a method of redistributing an N-primary color input signal into an N-primary color output signal under a desired constraint.

A first aspect of the invention provides a method of redistributing an N primary color input signal into an N-primary color output signal under a constraint as claimed in claim 1. A second aspect of the invention provides a computer program product as claimed in claim 9. A third aspect of the invention provides a system for redistributing a N-primary color input signal into a N-primary color output signal under a desired constraint as claimed in claim 11. A fourth aspect of the invention provides a display apparatus as claimed in claim 12. A fifth aspect of the invention provides a camera as claimed in claim 13. A sixth aspect provides a portable device as claimed in claim 14. Advantageous embodiments are defined in the dependent claims.

The method redistributes the N-primary color input signal into the N-primary color output signal under a desired constraint. The N-primary color input signal comprises a sequence of samples of the input signal. Each sample comprises N primary color input components which define the contributions of the N primaries to this sample. The N primary color input components are also referred to as the input components. The N-primary color output signal comprises a sequence of samples which each comprise N primary color output components. The N primary color output components are also referred to as the output components. The N output components may be used to drive the N sub-pixels of a display device.

Three functions are defined which represent three of the N output components as a function of the remaining N-3 output components. The values of the N input components are substituted into the three functions to determine unknown coefficients of the three functions. The optimal values of the N output components are determined by applying at least one constraint to the three functions. The optimal values of the N output components may be determined in a single step, or first the N-3 optimal values of the N-3 output components are determined and then, according to the equations, the optimal values of the three output components.

This method uses the values of the N input components to determine the three functions. Thus, the selected non-optimal solution by the multi-primary conversion, which generated the N-primary color input signal from three color input signals, is converted into ranges of possible values of the three primary color input signal which are defined by the functions. Once these ranges of possible values are available it is possible to select an optimal value within these ranges which fits a desired constraint.

Thus, if the prior art selected a non-optimal solution out of the many solutions possible, the redistribution in accordance with the present invention allows to select a desired solution which differs from the non-optimal solution. The desired solution depends on which constraint is used. Such a constraint may, for example, be an equal luminance constraint or a minimized maximum drive constraint.

In an embodiment as claimed in claim 2, the redistributing occurs in a linear light domain, and the three functions are three linear functions. Preferably, the redistribution is performed in the linear X, Y, Z space. The linear functions have the advantage that the redistribution process can be performed with relatively fast software or simple hardware.

In an embodiment as claimed in claim 4, the constraint is a further equation which is added to the three equations. The further equation preferably defines a relation between the variables (the output components) of the three equations. The optimal solution may be determined uniquely by the fourth equation, or a range is found wherein the optimal solution may be selected.

In an embodiment as claimed in claim 5, the further equation defines a linear combination between at least a first subset of the N output components and a second subset of the N output components. Preferably, such a linear combination of the first subset represents the luminance of the first subset of output components, and the linear combination of the second subset represents the luminance of the second subset of output components. These linear combinations may be used to define an equal luminance constraint. The extra equation defines that the subtraction of the linear combination of the second subset from the first subset, or the other way around, is zero. Other constraints are possible, for example, such that the luminance of first linear combination should be lower than the luminance of the second linear combination.

In an embodiment as claimed in claim 6, for N=4 only four output components are present. Now, the three functions represent the first, second, and third output component as function of the fourth output component. The output components are suitable for driving four primary colors of a multi-primary color additive display, but may be used for other purposes. The intersection values of the fourth output component are determined at a set of intersections of: the three functions mutually, and of the three functions and a line defined by the fourth drive signal being equal to itself. Only the intersection values of functions which have opposite signs of their first derivative are relevant. The associated first, second and third output components at the intersection values of the fourth output component, and at boundary values of a valid range of the fourth output component wherein all output components have valid values, are calculated to obtain calculated values. The values of interest are defined to comprise the intersection values and the boundary values and the associated calculated values.

A maximum value or minimum value of the values of interest is selected at the intersection values and the boundary values, and the intersection value or the boundary value is selected at which the maximum value or minimum value is minimum or maximum, respectively.

In an embodiment as claimed in claim 8, an adapted second constraint is defined as a linear combination of solutions associated with the first constraint and the second constraint if the first constraint and the second constraint cannot be satisfied simultaneously. It might be that the input components are obtained by using a particular first constraint. If now the input components are redistributed into the output components under an optimal second constraint, the deviation with respect to the first constraint may become too large. Then, it might be more optimal to define another second constraint which gives rise to a solution which is in-between the solutions associated with the first and the optimal second constraint. In such an implementation the another second constraint is considered to be the optimal choice for the second constraint.

These and other aspects of the invention are apparent from and will be elucidated with reference to the embodiments described hereinafter.

Figure 2:
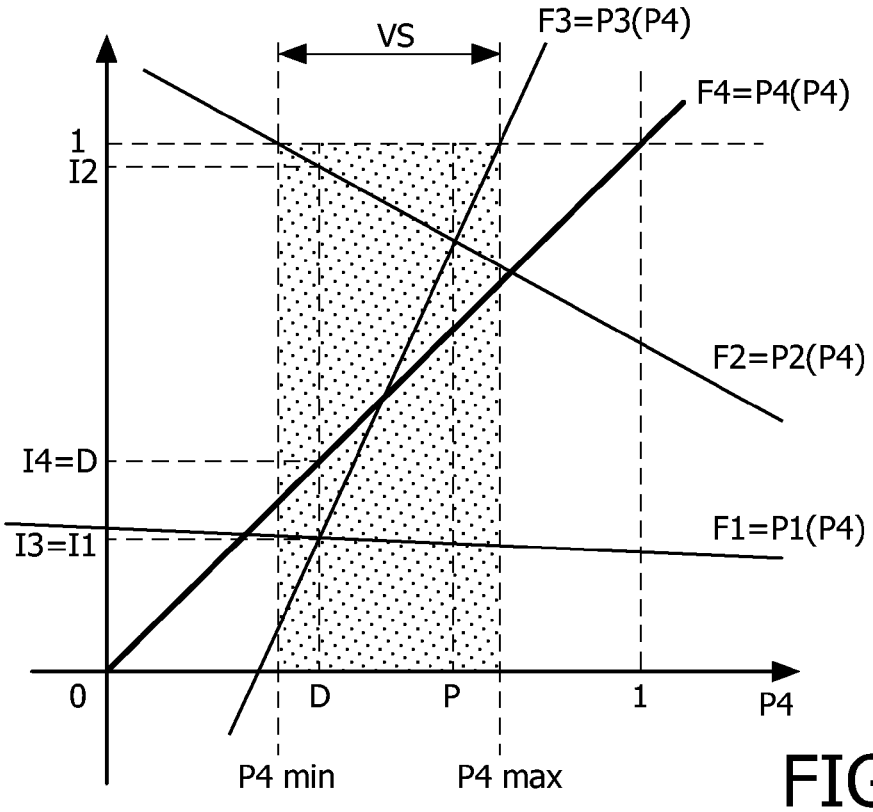
Figure 3:
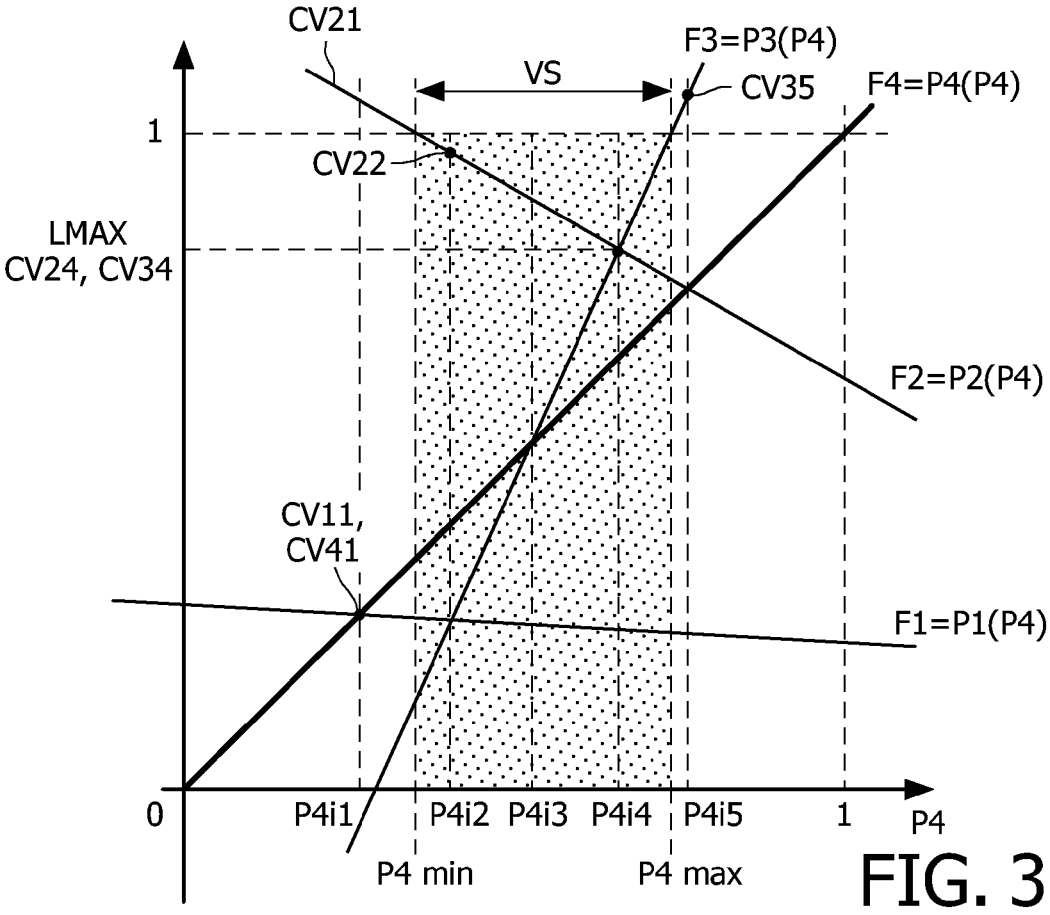
Figure 4:
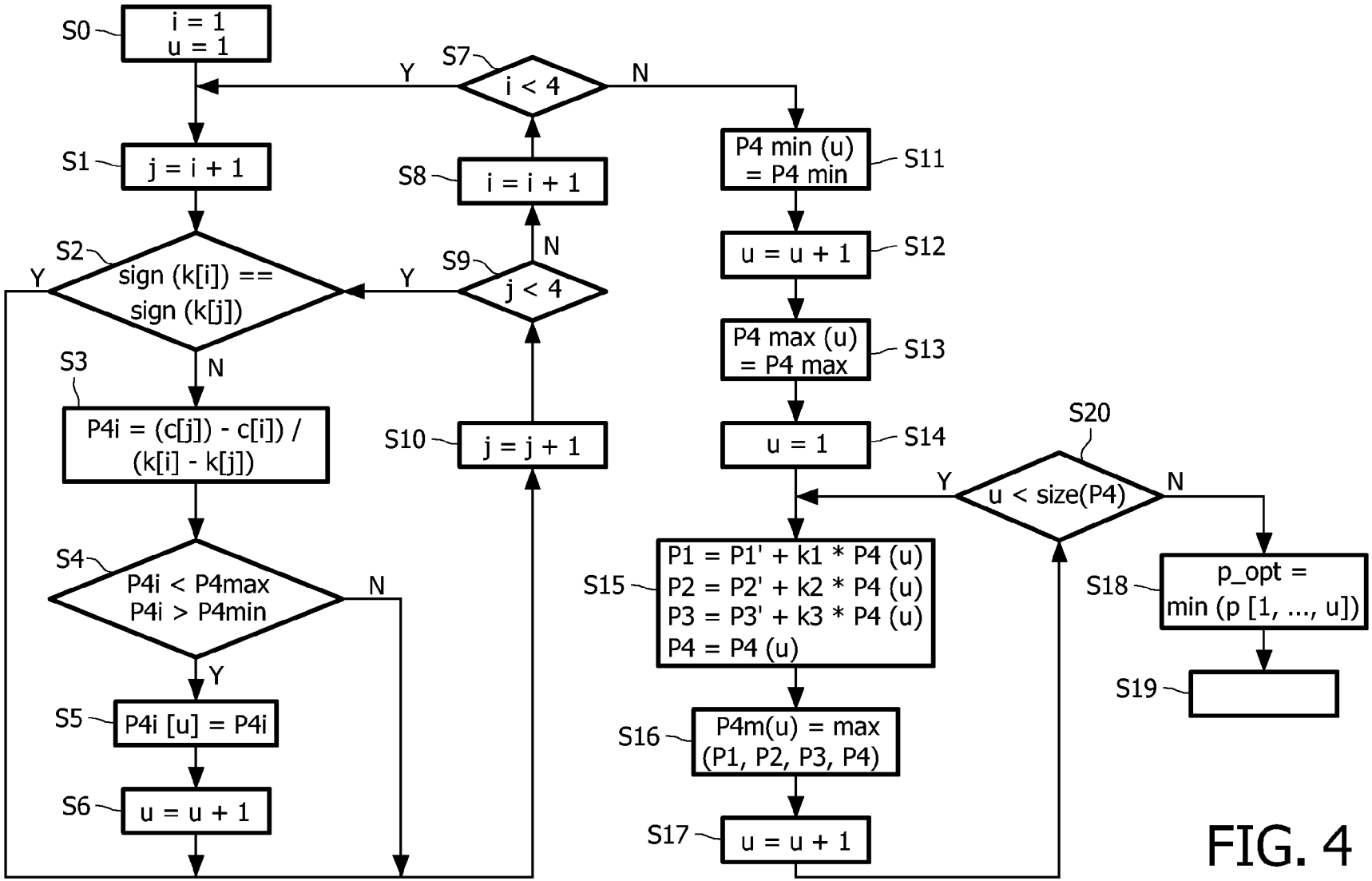
Figure 5:
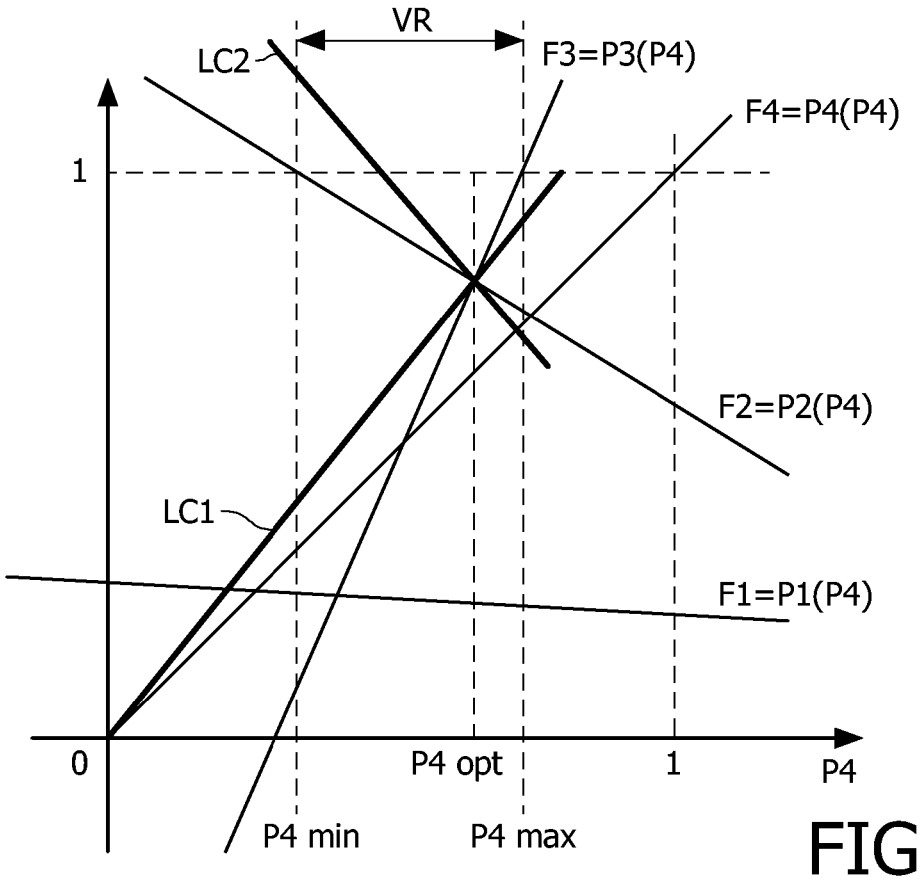
Figure 6:
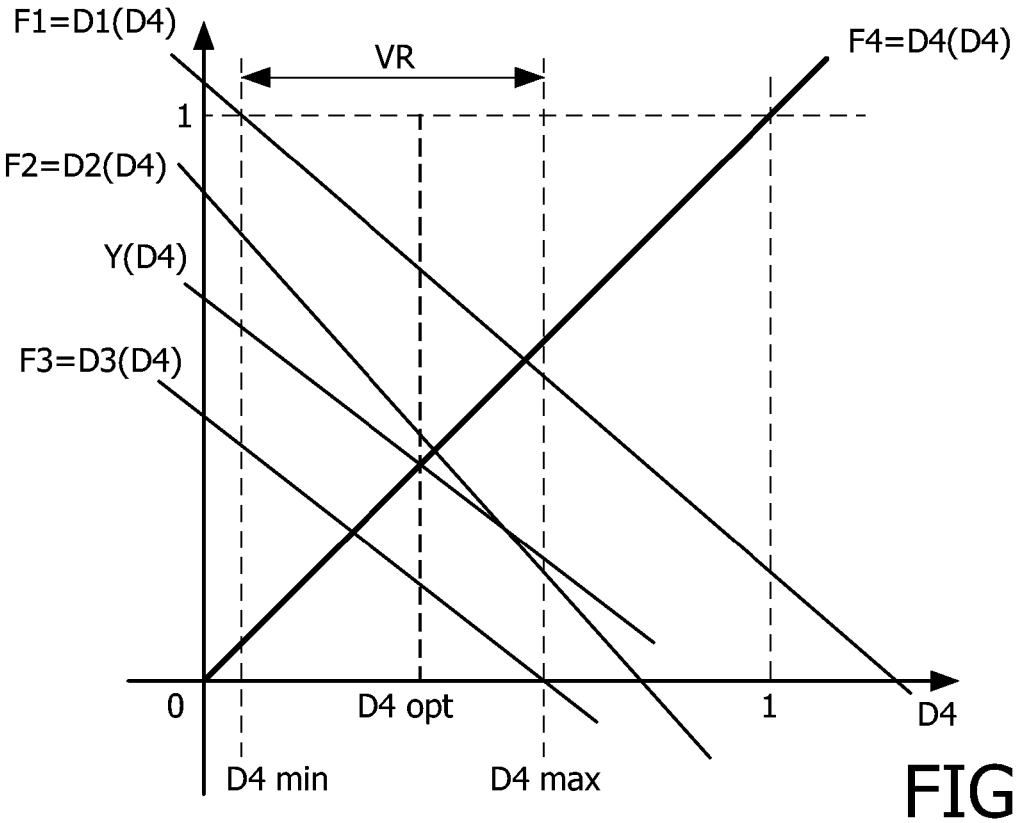

In the drawings:

FIG. 1 shows a schematically block diagram of an embodiment of the multi-primary redistribution, FIG. 2 shows an embodiment of the three functions and an example of the application of a constraint thereon, FIG. 3 shows the application of a minimum/maximum constraint, FIG. 4 shows a flowchart of an algorithm for applying the minimum/maximum constraint, FIG. 5 shows the application of an equal luminance constraint, and FIG. 6 shows the application of another equal luminance constraint.

It should be noted that items which have the same reference numbers in different Figures, have the same structural features and the same functions, or are the same signals. Where the function and/or structure of such an item has been explained, there is no necessity for repeated explanation thereof in the detailed description.

FIG. 1 shows a schematically block diagram of an embodiment of the multi-primary redistribution. The multi-primary redistribution MPR comprises a conversion unit MPRC, a constraint unit CON2, and a parameter unit PCP. These units may be hardware or software modules. The conversion unit MPRC performs the multi-primary redistribution. The constraint unit CON2 provides a constraint CON2 to the conversion unit MPRC. The parameter unit PCP provides primary color parameters to the conversion unit MPRC.

The conversion unit MPRC receives an N-primary input signal IS and supplies an N-primary output signal OS. The N-primary input signal IS comprises a set of input samples which each comprise N input components I1 to IN. The input components I1 to IN of a particular input sample define the color and intensity of this input sample. The input samples may be the samples of an image which, for example, is produced by a camera or a computer. The N-primary output signal OS comprises a sequence of samples which each comprise N output components P1 to PN. The output components P1 to PN of a particular output sample define the color and intensity of the output sample. Usually the output samples are displayed on pixels of a display device. The output components define the drive values for the sub-pixels of the pixels. For example, in a RGBW display device the pixels have four sub-pixels which supply red (R), green (G), blue (B), and white (W) light. Now, a particular output sample has four output components which supply the drive signals for the four sub-pixels of a particular pixel.

The conversion unit MPRC converts the N-primary input signal IS into the N-primary output signal OS under the constraint CON2. The conversion unit MPRC defines three functions F1, F2, F3 which represent three P1, P2, P3 of the N-primary color output components P1, . . . , PN as a function of the remaining N-3 primary color output signal components P4, . . . , PN. The functions have unknown coefficients P1', P2', P3' (if the functions are linear functions) which are determined by primary color parameters supplied by the parameter unit PCP. The values of the primary color input components I1, . . . , IN are substituted into the three functions F1, F2, F3 to determine the unknown coefficients P1', P2', P3' of the three functions F1, F2, F3. Once the coefficients P1', P2', P3' are determined, the functions provide the relation between the three output components P1 to P3 and the remaining output components P4 to PN of an output sample. Usually a range of possible solutions exist for these three functions F1, F2, F3. This possible range allows selecting a solution which optimally fits the constraint CON2, and thus optimal values of the N output components P1 to PN are obtained by applying the constraint CON2 to the three functions F1, F2, F3.

For non-linear functions several sets of coefficients may have to be determined by substituting the values the primary color input components I1, . . . , IN of several input samples into the three functions F1, F2, F3. The operation of the conversion unit MPRC is elucidated in more detail for linear functions, which occur in the linear light domain defined by the XYZ color space, in FIGS. 2 to 6. If the input components I1 to IN are not in the linear light domain, they may be converted into it.

The multi-primary redistribution MPR may optionally comprise a multi-primary conversion unit MPC which converts a three-primary input signal which has three components R, G, B into the color input components I1 to IN with N≧4. Preferably, this three-primary input signal is converted to the three input signals Cx, Cy, Cz in the linear light domain.

FIG. 2 shows an embodiment of the three functions and an example of the application of a constraint thereon for N=4. The three drive signals P1 to P3 are defined as functions of the fourth drive signal P4: F1=P1(P4), F2=P2(P4), and F3=P3(P4). The fourth drive signal P4 is a straight line F4=F4(P4) through the origin and has a first derivative which is one. The valid ranges of the four drive signals P1 to P4 are normalized to the interval 0 to 1. The common range VS of the fourth drive signal P4 in which all the four drive signals P1 to P4 have values within their valid ranges extends from the value P4min to P4max including its border values. The fourth output component P4 is depicted along the horizontal axis, and the three output components P1 to P3 together with the fourth output component P4 along the vertical axis. Usually, the output components P1 to P4 are used to drive the sub-pixels of the display 3, and in the now following are also referred to as drive signals. The output components P1 to P4 of a same output sample may drive the sub-pixels of a same pixel. Alternatively, the output components P1 to P4 of adjacent samples may be sub-sampled to sub-pixels of the same pixel. Now, not all output components P1 to P4 are actually assigned to a sub-pixel.

In this example, a linear light domain is selected wherein the functions defining the three drive signals P1 to P3 as a function of the fourth drive signal P4 are defined by the linear functions $$\begin{bmatrix} P1 \\ P2 \\ P3 \end{bmatrix} = \begin{bmatrix} P1' \\ P2' \\ P3' \end{bmatrix} + \begin{bmatrix} k1 \\ k2 \\ k3 \end{bmatrix} \times P4$$

wherein P1 to P3 are the three drive signals, (P1', P2', P3') are defined by the input signal which usually is a RGB signal, and the coefficients ki define a dependence between the color points of the 3 primaries associated with the 3 drive values P1 to P3, and the primary associated with the fourth drive signal P4.

To further elucidate the relation between the elements of these functions it is now shown how the above functions relate to the standard three to four primary conversion. In a standard three to four primary conversion, the drive signal DS, which comprises the drive signals P1 to P4, is transformed to the linear color space XYZ by the following matrix operation.

$$\begin{bmatrix} Cx \\ Cy \\ Cz \end{bmatrix} = \begin{bmatrix} t11 & t12 & t13 & t14 \\ t21 & t22 & t23 & t24 \\ t31 & t32 & t33 & t34 \end{bmatrix} \times \begin{bmatrix} P1 \\ P2 \\ P3 \\ P4 \end{bmatrix} = [T] \times \begin{bmatrix} P1 \\ P2 \\ P3 \\ P4 \end{bmatrix} \quad \text{Equation 1}$$

The matrix with the coefficients tij defines the color coordinates of the four primaries of the four sub-pixels. The drive signals P1 to P4 are unknowns which have to be determined by the multi-primary conversion. This equation 1 cannot be solved immediately because there are multiple possible solutions as a result of introducing the fourth primary. A particular selection out of these possibilities for the drive values of the drive signals P1 to P4 is found by applying a constraint.

Equation 1 can be rewritten into:

$$\begin{bmatrix} Cx \\ Cy \\ Cz \end{bmatrix} = [A] \times \begin{bmatrix} P1 \\ P2 \\ P3 \end{bmatrix} + \begin{bmatrix} t14 \\ t24 \\ t34 \end{bmatrix} \times P4 \quad A = \begin{bmatrix} t11 & t12 & t13 \\ t21 & t22 & t23 \\ t31 & t32 & t33 \end{bmatrix} \quad \text{Equation 2}$$

wherein the matrix [A] is defined as the transforming matrix in the standard three primary system. Multiplication of the terms of equation 2 with the inverse matrix $[A^{-1}]$ provides Equation 3.

$$\begin{bmatrix} P1' \\ P2' \\ P3' \end{bmatrix} = \begin{bmatrix} P1 \\ P2 \\ P3 \end{bmatrix} + [A^{-1}] \times \begin{bmatrix} t14 \\ t24 \\ t34 \end{bmatrix} \times P4 \quad \text{Equation 3}$$

The vector [P1' P2" P3'] represents primary values obtained if the display system only contains three primaries. Finally, Equation 3 is rewritten into Equation 4.

$$\begin{bmatrix} P1 \\ P2 \\ P3 \end{bmatrix} = \begin{bmatrix} P1' \\ P2' \\ P3' \end{bmatrix} + \begin{bmatrix} k1 \\ k2 \\ k3 \end{bmatrix} \times P4 \quad \text{Equation 4}$$

Thus, the driving signal of any three primaries P1 to P3 is expressed by Equation 4 as a function of the fourth primary P4. These linear functions define three lines in a 2 dimensional space defined by the fourth primary P4 and the values of the fourth primary P4 as is illustrated in FIG. 2. All values in FIG. 2 are normalized which means that the values of the four drive values P1 to P4 have to be within the range $0 \leqq Pi \leqq 1$. From FIG. 2 it directly visually becomes clear what the common range VS of P4 is for which all the functions P1 to P3 have values which are in the valid range. It has to be noted that the coefficients k1 to k3 are predefined by the color coordinates of the sub-pixels associated with the drive values P1 to P4.

In the example shown in FIG. 2, the boundary P4min of the valid range VS is determined by the function F2 which has a higher value than 1 for values of P4 smaller than P4min. The boundary P4max of the valid range VS is determined by the function F3 which has a higher value than 1 for values of P4 larger than P4max. Basically, if no such common range VS exists, then the input color is outside the four primary color gamut and thus cannot be correctly reproduced. For such colors a clipping algorithm should be applied which clips these colors to the gamut. A scheme which calculates the common range P4min to P4max is elucidated in the non pre-published European patent application 05102641.7.

The input components I1 to I4 which are to be converted to the output components P1 to P4 under the constraint CON2, are the known input values I1, I2, I3, I4 which are indicated in FIG. 2 at the intersection points of the functions F1, F2, F3 with the vertical line at P4=D. By substituting these values for the drive values P1 to P4 in equation 4 the values of P1', P2' and P3' are determined. Now, the lines which define the functions F1 to F3 are known, and it is possible to select another set of drive values P1 to P4 within the valid range VS. It does not matter for the color and intensity displayed which one of the values of the drive value P4 is selected in the valid range VS. However, the constraint CON2 defines the optimal selection. In the example shown, the constraint CON2 is that the set of drive values P1 to P4 should be selected in the valid range which gives rise to the lowest value of the highest drive value. In the example shown this occurs for the value P4=P where the functions F2 and F3 intersect. The algorithm for finding this particular optimum under the minimum/maximum constraint will be elucidated in detail with respect to FIG. 3. Many other constraints are possible such as for example an equal luminance constraint, or a lowest value for a particular drive value P1 to P4.

It has to be noted that the four input components I1 to I4, which are obtained from the three input components R, G, B, define the unknown coefficients of the three functions F1 to F2. Once these unknown coefficients are determined, the three functions F1 to F3 define the conversion from the three input components Cx, Cy, Cz (equation 1) to the N output components P1 to PN. The components Cx, Cy, Cz in the linear XYZ color space may be obtained by recalculating the input components R, G, B, or may be directly available instead of the input components R, G, B. Now, the full valid range VR is available to select the solution for the four drive values P1 to P4 of the output sample OS. The optimal solution of the four drive values P1 to P4 is found by implementing the constraint on the selection. The determination of the three functions and is elucidated with respect to FIG. 2. Further, with respect to FIG. 2, the application of a constraint on these three functions to find the desired optimal choice of the four drive values P1 to P4 is elucidated shortly with respect to the minimum/maximum constraint. The implementation of the constraint on these three functions F1 to F3 is elucidated in detail for a minimum/maximum constraint in FIG. 3, and for equal luminance constraints in FIGS. 5 and 6.

FIG. 3 shows the application of the minimum/maximum constraint. The particular constraint CON2 is implemented such that out of the possible mappings from the N input signals I1 to IN to the N drive signals P1 to PN an optimal one is selected. Wherein, in this embodiment, the minimum/maximum constraint determines the selection of the drive values P1 to P4 for which the maximum drive value is minimal. This is elucidated with respect to FIG. 3 for N=4. Alternatively, the maximum value of the minimum drive value may be determined. FIG. 3 shows the same functions F1 to F4 as FIG. 2.

The algorithm applied is elucidated in the now following. First the three functions F1=P1(P4), F2=P2(P4), and F3=P3(P4) representing the first, second, and third drive signal P1, P2, P3 as a function of the fourth drive signal P4 are determined. Then, the intersection values P4*i* of the fourth drive signal P4 are determined at a set of intersections of: the three functions F1, F2, F3 mutually, and of the three functions F1, F2, F3 and the line F4 defined by the fourth drive signal P4 being equal to itself. Only the intersection values P4*i* of functions having opposite signs of their first derivative are relevant.

The intersection of the functions F1 and F4 occurs at the value P4*i*1 of the fourth drive value P4. The intersection of the functions F1 and F3 occurs at the value P4*i*2 of the fourth drive value P4. The intersection of the functions F3 and F4 occurs at the value P4*i*3 of the fourth drive value P4. The intersection of the functions F2 and F3 occurs at the value P4*i*4 of the fourth drive value P4. The intersection of the functions F2 and F4 occurs at the value P4*i*5 of the fourth drive value P4. The intersection of the functions F1 and F2 is not shown.

The intersection at P4*i*3 and the intersection of the functions F1 and F2 are not relevant because the first derivative of the intersecting functions has the same sign. Also, the intersections P4*i*1 and P4*i*5 are not relevant, because these intersections are outside the valid range VS. At each one of the other intersections P4*i*2, P4*i*4, and at the border values P4min, P4max the values of the functions F1 to F3 are determined. In the example shown, only the values CV11, CV21, CV31 of the functions F1 to F3 at the intersection P4*i*1 and the values CV14, CV24, CV34 at the intersection P4*i*4 are shown. The value of the function F4 at the intersection P4*i*1 and P4*i*4 is equal to the intersection value.

Now, the first, second and third drive signals P1, P2, P3 at the intersection values P4*i* of the fourth drive signal P4 are calculated to obtain calculated values CV1, CV2, CV3. Further, the associated first, second and third drive signals P1, P2, P3 are calculated at the boundary values P4min, P4max of a valid range VR of the fourth drive signal P4. These sets of values are referred to as the values of interest (CV1, CV2, CV3, P4*i*) which comprise the intersection values P4*i* and the boundary values P4min, P4max of the fourth drive signal P4 and the associated calculated values CV1, CV2, CV3. For each set, a maximum value Vmax or minimum value Vmin of the values of interest CV1, CV2, CV3, P4*i* at the associated value of the fourth drive value P4 is determined. The associated value P4 is either one of the intersection values or one of the maximum value Vmax or minimum value Vmin.

In the example shown, the highest value of the functions F1 to F4 is for the border values and the intersection values within the valid range: P4min, P4*i*2, P4*i*4, P4max, respectively: 1, CV22, LMAX, 1.

Finally, the value of the fourth drive value P4 at which the maximum value Vmax or minimum value Vmin is minimum or maximum, respectively, is selected. In the example shown the minimal highest value of the functions at the intersection or border values are the values CV24 and CV34 of the functions F2 and F3, respectively, at the intersection value P4*i*4. These minimal highest values are indicated by LMAX.

This algorithm is further elucidated with respect to the flowchart of FIG. 4. The four input signals I1 to I4 may be supplied by the multi-primary conversion MPC, a processing circuit, or a camera.

FIG. 4 shows a flowchart of an algorithm for applying the minimum/maximum constraint. In step S0 the variables i and u are set to zero. In step 1 the variable j is made equal to the variable i+1. In step S2, the sign of the coefficient k(i) is compared with the sign of coefficient k(j), wherein the coefficients k(i) and (kj) are the coefficients k1 to k3 in equation 4. If the signs are equal, the algorithm proceeds with step S10 and increments the variable j by 1. In step S9 it is checked whether the incremented variable j is smaller than 4. If yes the algorithm proceeds with step S2 if no, in step S8, the variable i is incremented by 1 and in step S7 is checked whether the incremented variable i is smaller than 4. If yes the algorithm proceeds with step S1, if no, the algorithm proceeds with step S11.

If in step S2 is detected that the signs are not equal, and thus the lines have opposite signs of the first derivative, in step S3 the intersection value P4*i* of the two lines is determined by the equation $$P4i=(Pj'-Pi')/(ki-kj)$$

wherein the Pj' and Pi' are respective ones of the P1' to P4' of equation 4 to which is added that the fourth drive signal (P4) which is equal to itself is defined by $$P4=P4'+k4*P4 \text{ wherein } P4'=0 \text{ and } k4=1.$$

In step S4 is checked whether the intersection value P4*i* is smaller than the upper limit P4max of the valid range and larger than the lower limit P4min of the valid range. If the intersection value P4*i* is not within the valid range, the algorithm proceeds with step S10. If the intersection value P4*i* is within the valid range, in step S5 its value is stored as P4(*u*), and in step S6 the value of u is incremented by 1.

In step S11, the lower border value P4min is stored as P4(*u*), in step S12 the value of u is incremented by 1, in step S13 the border value P4max is stored as P4(*u*), and in step S14 the variable u is set to 1. In step S15, for the actual value of u, the values P1 to P3 are calculated by using equation 4 for the value of P4 stored for this value of u. The stored value of P4 is indicated by P4(*u*) and is either one of the intersection values P4*i* or one of the border values P4min, P4max. Also the stored value P4(*u*) itself is retrieved as the value for P4.

In step S16, the maximum value of the values P1 to P4 is stored as P4*m*(*u*). In step S17, the value of u is incremented by 1, and in step S20 is checked whether u<size (P4). Wherein the size (P4) is a number which is the sum of the number of intersection values P4*i* and the two border values P4min, P4max.

If yes, the values of P1 to P4 are calculated in step S15. In step S16, the maximum value P4*m*(*u*) of the values P1 to P4 is determined and stored. In step S17 the variable u is incremented by 1, and the algorithm proceeds with step S20. After calculation of all the maximum values, the outcome of the check in step S20 is no, and the in step S18, the minimum value P4opt of all the stored maximum values P4$m(u)$ is determined. The core of the algorithm now ends in step S19.

The values of the other drive values P1 to P3 can now be calculated by substituting this optimal value P4opt in the three functions F1 to F3. This minimum value P4opt (which is Pui4 in FIG. 2) defines the selected mapping, which may be considered to be a mapping from the three primary color input signals Cx, Cy, Cz (see equation 2) into the four drive values P1 to P4, wherein the selection is performed in using a particular constraint. The particular constraint is that, of the set of values of the functions F1 to F4 in all points of interest, the set of values is selected of which the maximum value is minimal. The points of interest comprise all intersection points P4$i$ of the functions F1 to F4 and the two border values P4min, P4max. Alternatively, the particular constraint may be that, of the set of values in every point of interest, the minimum value is determined and that the point of interest is selected at which this minimal value is maximal.

If all the intersections are outside the valid range VS, p4opt will be equal to one of the boundary values p4min or p4max.

FIG. 5 shows the application of an equal luminance constraint for N=4. FIG. 5 shows the three drive components P1 to P3 as a function of the fourth drive component P4. The fourth drive component P4 is depicted along the horizontal axis, and the three drive components P1 to P3 together with the fourth drive component P4 along the vertical axis. Usually, the drive components P1 to P4 are used to drive sets of sub-pixels of the display 3, and in the now following are also referred to as drive signals. The drive components P1 to P4 of a same drive sample may drive the sub-pixels of a same pixel. Alternatively, the drive components P1 to P4 of adjacent samples may be sub-sampled to sub-pixels of the same pixel. Now, not all drive components P1 to P4 are actually assigned to a sub-pixel.

The three drive signals P1 to P3 are defined as functions of the fourth drive signal P4:F1=P1(P4), F2=P2(P4), and F3=P3(P4). The fourth drive signal P4 is a straight line through the origin and has a first derivative which is one. The valid ranges of the four drive signals P1 to P4 are normalized to the interval 0 to 1. The common range VR of the fourth drive signal P4 in which all the four drive signals P1 to P4 have values within their valid ranges extends from the value P4min to P4max, and includes these border values.

In this example, a linear light domain is selected wherein the functions defining the three drive signals P1 to P3 as a function of the fourth drive signal P4 are defined by the linear functions as defined in Equation 4.

In the example shown in FIG. 5, the boundary P4min of the valid range VR is determined by the function F2 which has a higher value than 1 for values of P4 smaller than P4min. The boundary P4max of the valid range VS is determined by the function F3 which has a higher value than 1 for values of P4 larger than P4max. Basically, if no such common range VR exists, then the input color is outside the four primary color gamut and thus cannot be correctly reproduced. For such colors a clipping algorithm should be applied which clips these colors to the gamut. A scheme which calculates the common range P4min to P4max is elucidated in the non pre-published European patent application 05102641.7, which is incorporated herewith by reference. The existence of the common range VR indicates that many possible solutions exist for the conversion from the particular values of the four input components I1 to I4 to the four drive components P1 to P4. The valid range VR contains all possible values of the drive component P4 which provide a conversion for which the intensity and color of the four sub-pixels is exactly corresponding to that indicated by the four input components I1 to I4. The values of the other three drive components P1 to P3 are found by substituting the selected value of the drive component P4 into Equation 4.

FIG. 5 further shows the lines LC1 and LC2. The line LC1 represents the luminance of the drive component P4 and its associated sub-pixel. The line LC2 represents the luminance of the drive components P1 to P3, which is a weighted linear combination of the three drive components P1 to P3 such that this linear combination represents the luminance of the combination of the sub-pixels associated with these three drive components P1 to P3. At the intersection of these lines LC1 and LC2, which occurs for the drive value P4opt, the luminance of the drive component P4 is equal to the luminance of the combination of the drive components P1 to P3.

This equal luminance constraint is especially interesting for a spectral sequential display which drives one set of the primaries during the even frames and the remaining set of primaries during the odd frames. The algorithm processes a given input color under the equal luminance constraint into output components D1 to DN such that the luminance generated by the first subset of sub-pixels during the even frames is equal to the luminance generated by the second subset of the sub-pixels during the odd frames. Thus, the first subset of the N drive components drives the first subset of sub-pixels during the even frames, and the second subset of the N drive components drives the second subset of the sub-pixel during the odd frames, or the other way around. If for a given input color it is impossible to reach an equal luminance during both frames, either the input color is clipped to a value which allows equal luminances, or the output components are clipped to obtain an as equal as possible luminance.

For example, in a RGBY display (R=red, G=green, B=blue, and Y=yellow), only the blue and green sub-pixels are driven in the even frames while only the red and yellow sub-pixels are driven in the odd frames, or the other way around. Of course any other combination of colors is possible also. In this example, in FIG. 5, the two lines LC1 and LC2 should represent the luminance of the blue plus green drive components, and the luminance of the yellow and red drive components, respectively. The value D4opt of the drive component D4 at which these two lines LC1 and LC2 intersect is the optimal value at which the luminance of the blue and green sub-pixels is equal to the luminance of red and yellow sub-pixels. This approach minimizes temporal flicker.

Because, once the three functions are defined, in fact a three input signal Cx, Cy, Cz is converted into the four drive signals P1 to P4, the constraint may be considered to be an extension of Equation 1 by adding a fourth row to the matrix T. The fourth row defines the additional equation $$t21*D1+t22*D2-t23*D3-t24*D4=0$$

The coefficients are t21 to t24 because Cy defines the luminance. This additional equation adds the equal luminance constraint to Equation 1. Thus, the solution of the extended equation provides equal luminances for the sub-pixels which are driven by the drive components P1 and P2 on the one hand, and for the sub-pixels which are driven by the drive components P3 and P4 on the other hand. The extended equation is defined by $$\begin{bmatrix} Cx \\ Cy \\ Cz \\ 0 \end{bmatrix} = \begin{bmatrix} t11 & t12 & t13 & t14 \\ t21 & t22 & t23 & t24 \\ t31 & t32 & t33 & t34 \\ t21 & t22 & -t23 & -t24 \end{bmatrix} \times \begin{bmatrix} P1 \\ P2 \\ P3 \\ P4 \end{bmatrix} = [TC] \times \begin{bmatrix} P1 \\ P2 \\ P3 \\ P4 \end{bmatrix} \quad \text{Equation 5}$$

Equation 5 can be easily solved by calculating $$\begin{bmatrix} P1 \\ P2 \\ P3 \\ P4 \end{bmatrix} = \begin{bmatrix} TC11 & TC12 & TC13 & TC14 \\ TC21 & TC22 & TC23 & TC24 \\ TC31 & TC32 & TC33 & TC34 \\ TC41 & TC42 & TC43 & TC44 \end{bmatrix} \times \begin{bmatrix} Cx \\ Cy \\ Cz \\ 0 \end{bmatrix} = [TC^{-1}] \times \begin{bmatrix} Cx \\ Cy \\ Cz \\ 0 \end{bmatrix}$$

wherein $[TC^{-1}]$ is the inverse matrix of [TC].

The solution for the drive components P1 to P4 makes sense if all drive components P1 to P4 have valid values, which if normalized, is true if $0 \leqq Pi \leqq 1$ for i=1 to 4. The optimal drive value P4opt of the drive component P4 corresponds to the drive value allowing flicker free operation, and is defined by $$P4opt = TC41*Cx + TC42*Cy + TC43*Z \quad \text{Equation 6}$$

The coefficients TC41, TC42, TC43 do not depend on the input color. The values of the other drive components D1 to D4 are calculated by using Equation 4. As long as the optimal drive value D4opt occurs within the valid range VR, the solution provides equal luminance in both even and odd sub-frames.

FIG. 6 shows the application of another equal luminance constraint for N=4. FIG. 6 shows an example wherein the display is an RGBW display. In this example, in the RGBW display, the drive component P1 drives the red sub-pixel, the drive component P2 drives the green sub-pixel, the drive component P3 drives the blue sub-pixel, and the drive component P4 drives the white sub-pixel. Now, if possible at the particular values of the input signal IS, the luminance of the RGB sub-pixels is kept equal to the luminance of the white pixel to minimize the spatial non-uniformity. Instead of RGBW, other colors may be used, as long as the color of the single sub-pixel can be produced by the combination of the other three sub-pixels.

FIG. 6 shows the three drive components P1 to P3 as a function of the fourth drive component P4. The fourth drive component P4 is depicted along the horizontal axis, and the three drive components P1 to P3 together with the fourth drive component P4 along the vertical axis. The drive components P1 to P4 which are used to drive the sub-pixels of the display, are in the now following also referred to as drive signals. The drive signals P1 to P4 of a same drive sample may drive the sub-pixels of a same pixel. Alternatively, the drive components P1 to P4 of adjacent samples may be sub-sampled to sub-pixels of the same pixel. Now, not all drive components P1 to P4 are actually assigned to a sub-pixel.

The three drive signals P1 to P3 are defined as functions of the fourth drive signal P4: F1=P1(P4), F2=P2(P4), and F3=P3(P4). The fourth drive signal P4 is a straight line through the origin and has a first derivative which is one. In this example, a linear light domain is selected wherein the functions F1 to F3 are straight lines. The valid ranges of the four drive signals P1 to P4 are normalized to the interval 0 to 1. The common range VR of the fourth drive signal P4 in which all the three drive signals P1 to P3 have values within their valid ranges extends from the value P4min to P4max, and includes these border values.

In this embodiment, the line F4 is supposed to also indicate the luminance of the white sub-pixel. The line Y(P4) indicates the combined luminance of the RGB sub-pixels for the particular input signal IS. The luminance indicated by the line Y(P4) is normalized towards the luminance of the white W sub-pixel such that at the intersection of the line Y(P4) which the line P4(P4) the combined luminance of the RGB sub-pixels is equal to the luminance of the W sub-pixel. This intersection occurs at the value P4opt of the drive component P4. Again, the values of the other drive components P1 to P3 are found by substituting P4opt in equation 4.

In a special situation wherein the chromaticity of the W sub-pixel coincides with the white point of the chromaticity diagram created by the RGB sub-pixels, the functions F1 to F3 become even simpler: all the coefficients k1 to k3 of Equation 4 have an equal negative value. Thus the lines representing the functions F1 to F3 intersect the line P4=P4 under the same angle. If further the maximal possible luminance of the W sub-pixel is equal to the maximal possible luminance of the RGB-sub-pixels, then all the coefficients k1 to k3 of Equation 4 have the value −1, and the lines representing the functions F1 to F3 intersect the line P4=P4 under 90 degrees.

This approach may be considered to add a fourth linear equation defining an equal luminance constraint to the three equations which define the relation between the four drive components P1 to P4 and the three input components Cx, Cy, Cz. In fact, Equation 1 has been extended by adding a fourth row to the matrix T. The fourth row defines the additional equation $$t21*P1 + t22*P2 + t23*P3 - t24*P4 = 0$$

The coefficients are t21 to t24 because Cy defines the luminance in the linear XYZ color space. The first subset contains the linear combination of the drive values P1, P2 and P3 which drive the RGB sub-pixels SP1, SP2, SP3. The second subset contains a linear combination which comprises the drive value P4 only. This additional equation adds an equal luminance constraint to Equation 1. Thus, the solution of the extended equation provides equal luminances for the combined luminance of the RGB sub-pixels which are driven by the drive components P1, P2 and P3 on the one hand, and for the W sub-pixel which is driven by the drive component P4 on the other hand. These equal luminances improve the spatial homogeneity between the RGB and W sub-pixels.

The extended equation is defined by $$\begin{bmatrix} Cx \\ Cy \\ Cz \\ 0 \end{bmatrix} = \begin{bmatrix} t11 & t12 & t13 & t14 \\ t21 & t22 & t23 & t24 \\ t31 & t32 & t33 & t34 \\ t21 & t22 & t23 & -t24 \end{bmatrix} \times \begin{bmatrix} P1 \\ P2 \\ P3 \\ P4 \end{bmatrix} = [TC'] \times \begin{bmatrix} P1 \\ P2 \\ P3 \\ P4 \end{bmatrix} \quad \text{Equation 7}$$

Equation 6 can be easily solved by calculating $$\begin{bmatrix} P1 \\ P2 \\ P3 \\ P4 \end{bmatrix} = \begin{bmatrix} TC11' & TC12' & TC13' & TC14' \\ TC21' & TC22' & TC23' & TC24' \\ TC31' & TC32' & TC33' & TC34' \\ TC41' & TC42' & TC43' & TC44' \end{bmatrix} \times \begin{bmatrix} Cx \\ Cy \\ Cz \\ 0 \end{bmatrix} = [TC'^{-1}] \times \begin{bmatrix} Cx \\ Cy \\ Cz \\ 0 \end{bmatrix}$$

wherein $[TC'^{-1}]$ is the inverse matrix of [TC'].

The optimal drive value D4opt of the drive component D4 corresponds to the drive value allowing optimal spatial homogeneity, and is thus defined by $$P4opt=TC41'*Cx+TC42'*Cy+TC43'*CZ. \quad \text{Equation 8}$$

It has to be noted that Equation 8 has the same structure as Equation 6, only the matrix coefficients are different. Thus, the same algorithm with different input parameters to cover for the different matrix coefficients can be used.

As discussed for the example with respect to FIG. 5, if the optimal drive value P4opt determined occurs outside the valid range VR, this optimal drive value is clipped to the nearest boundary value P4min or P4max.

It has to be noted that the embodiments are elucidated for N=4 for a minimum/maximum constraint or an equal luminance constraint for spectral sequential display and for an RGBW display. However, the scope of the present invention is much wider as is defined by the claims. A same approach is possible for N>4. The determination of the three functions allows stepping back to the three input component Cx, Cy, Cz (or RGB) to the N drive signal P1 to PN conversion. The constraint narrows the possible solutions for this conversion. The extra linear equation imposes a weighted luminance constraint to the different sub-sets of drive components P1, . . . , PN. It is possible for N>4 to combine this luminance constraint with another constraint, such as for example a minimum of the maximum value of the drive components P1 to PN.

The algorithm is very attractive for portable or mobile applications which use a spectrum-sequential multi-primary display or an RGBW display. However, the algorithm can be used in other applications such as TV, computer, medical displays. The algorithm may only be used for the specific color components or for specific ranges of the input signal. For example, the algorithm may not include the drive components for sub-pixels which do not or only minimally contribute to artifacts. Or, the algorithm is not used for saturated or bright colors.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A method of redistributing an N-primary color input signal (IS) having a particular number ≧4 (N) of input components (I1, . . . , IN) into N-primary color output signal (OS) having the particular number (N) of output components (P1, . . . , PN) under a constraint (CON2), the method comprising:

defining, via a multi-primary redistribution conversion unit (MPRC), three functions (F1, F2, F3) representing (i) three (P1, P2, P3) of the output components (P1, . . . , PN) as a function of (ii) the remaining N-3 output components (P4, . . . , PN), wherein the functions (F1, F2, F3) define ranges of possible values of three input components of the N-primary color input signal;

substituting, via the multi-primary redistribution conversion unit (MPRC) and a primary color parameter unit (PCP), the values of the N input components (I1, . . . , IN) into the three functions (F1, F2, F3) to determine unknown coefficients (P1', P2', P3') of the three functions (F1, F2, F3); and determining, via the multi-primary redistribution conversion unit (MPRC) and a constraint unit, optimal values of the N output components (P1, . . . , PN) by (a) applying the constraint (CON2) to the three functions (F1, F2, F3), wherein the constraint (CON2) comprises (a)(i) an equal luminance drive constraint or (a)(ii) a minimum/maximum drive constraint, wherein the equal luminance drive constraint determines selection of drive values of the N output components (P1, . . . , PN) (a)(i)(1) defined by a linear combination of a first subset of the N output components that represents luminance of the first subset of output components and by a linear combination of a second subset of the N output components that represents luminance of the second subset of output components, and (a)(i)(2) subtraction of the linear combination of the second subset from the first subset is zero, wherein the minimum/maximum drive constraint determines selection of drive values of the N output components (P1, . . . , PN) for which (a)(ii)(1) a maximum drive value is a minimal value or (a)(ii)(2) a minimum drive value is a maximum value, and (b) selecting an optimal value for each respective output component within a valid range (VS) which fits the equal luminance or minimum/maximum drive constraint, wherein the valid range (VS) comprises a common range of a respective N-3 output component (P4, . . . , PN) for which all three functions (F1, F2, F3) have values which are in the common range, and wherein the optimal values of the N output components (P1, . . . , PN) are (i) determined in a single step, or (ii) first the optimal values of the N-3 output components (P4, . . . , PN) are determined and then, using the optimal values of the N-3 output components (P4, . . . , PN) in the three functions (F1, F2, F3), the optimal values of the three output components are determined.

2. The method of redistributing as claimed in claim 1, wherein the redistributing occurs in a linear light domain, and wherein the defining three functions (F1, F2, F3), via the multi-primary redistribution conversion unit (MPRC), defines three linear functions.

3. The method of redistributing as claimed in claim 2, wherein the defining the three functions (F1, F2, F3), via the multi-primary redistribution conversion unit (MPRC), defines the three linear functions (F1, F2, F3) as $$\begin{bmatrix} P1 \\ P2 \\ P3 \end{bmatrix} = \begin{bmatrix} P1' \\ P2' \\ P3' \end{bmatrix} + \begin{bmatrix} k1,1 & \dots & k1,N-3 \\ k2,1 & \dots & k2,N-3 \\ k3,1 & \dots & k3,N-3 \end{bmatrix} \times \begin{bmatrix} P4 \\ \dots \\ PN \end{bmatrix}$$

wherein P1 to PN are the N primary color output signals, the unknown coefficients are input signal dependent coefficients P1', P2', P3' which correspond to three input components (I1, I2, I3) when the output component(s) P4 to PN are zero, and matrix coefficients ki,j are predefined by a dependency between (i) three primary colors associated with the three output components P1 to P3, and (ii) N-3 other primary colors associated with the N-3 output component(s) P4 to PN; and the substituting the values of the N input components (I1, . . . , IN) into the three functions (F1, F2, F3) to determine coefficients (P1', P2', P3') of the three functions (F1, F2, F3), via the multi-primary redistribution conversion unit (MPRC) and the primary color parameter unit (PCP), provides the input signal dependent coefficients (P1', P2', P3').

4. The method of redistributing as claimed in claim 2, wherein the determining the optimal values, via the multi-primary redistribution conversion unit (MPRC) and the constraint unit, comprises at least adding a further equation to the three equations to obtain an extended set of equations, and determining a solution of the output components (P1, . . . , PN) for the extended set of equations.

5. The method of redistributing as claimed in claim 2, wherein a further equation defines a linear combination between at least a first subset of the N output components (P1, . . . , PN) and a second subset of the N output components (P1, . . . , PN).

6. A method of redistributing an N-primary color input signal (IS) having a particular number ≧4 (N) of input components (I1, . . . , IN) into N-primary color output signal (OS) having the particular number (N) of output components (P1, . . . , PN) under a constraint (CON2), the method comprising:

defining (MPRC) three functions (F1, F2, F3) representing three (P1, P2, P3) of the output components (P1, . . . , PN) as a function of the remaining N-3 output components (P4, . . . , PN);

substituting (MPRC) the values of the input components (I1, . . . , IN) into the three functions (F1, F2, F3) to determine unknown coefficients (P1', P2', P3') of the three functions (F1, F2, F3); and determining (MPRC) optimal values of the output components (P1, . . . , PN) by applying the constraint (CON2) to the three functions (F1, F2, F3), wherein the redistributing occurs in a linear light domain, and wherein the defining three functions (F1, F2, F3) defines three linear functions, and wherein N=4, and wherein the N-primary color output signal (OS) comprises a first, second, third, and fourth output component (P1, P2, P3, P4) for driving four primary colors of a multi-primary color additive display, wherein the defining the three functions (F1, F2, F3), defines three functions representing the first, second, and third output component (P1, P2, P3) as a function of the fourth output component (P4), and wherein the determining (MPRC) the optimal values further comprises:

determining intersection values (P4*i*) of the fourth output component (P4) at a set of intersections of: the three functions (F1, F2, F3) mutually, and of the three functions (F1, F2, F3) and a line (F4) defined by the fourth drive signal (P4) being equal to itself, wherein only the intersection values (P4*i*) of functions having opposite signs of their first derivative are relevant, calculating associated first, second and third output components (P1, P2, P3) at the intersection values (P4*i*) of the fourth output component (P4), and at boundary values (P4min, P4max) of a valid range (VR) of the fourth output component (P4) wherein all output components (P1, P2, P3, P4) have valid values, to obtain calculated values (CV1, CV2, CV3), determining values of interest (CV1, CV2, CV3, P4*i*) comprising the intersection values (P4*i*) and the boundary values (P4min, P4max) and the associated calculated values (CV1, CV2, CV3), selecting a maximum value (Vmax) or minimum value (Vmin) of the values of interest (CV1, CV2, CV3, P4*i*) at the intersection values (P4*i*) and the boundary values (P4min, P4max), and selecting the intersection value (P4*i*) or the boundary value (P4min, P4max) at which the maximum value (Vmax) or minimum value (Vmin) is minimum or maximum, respectively.

7. A method of driving a display device having sets of N sub-pixels, the method comprising:

converting, via a multi-primary conversion unit (MPC), a three-primary input signal (R, G, B) into an N-primary color input signal (IS) under a first constraint (CON1); and redistributing, via a multi-primary redistribution conversion unit (MPRC), the N-primary color input signal (IS) into the N-primary color output signal (OS) under a constraint (CON2) in accordance with claim 1, wherein the constraint mentioned in claim 1 is a second constraint (CON2).

8. The method of driving a display device as claimed in claim 7, wherein, if the first constraint (CONI) and the second constraint (CON2) cannot be satisfied simultaneously, the method further comprises defining, via the multi-primary redistribution conversion unit (MPRC), an adapted second constraint being defined by a linear combination of solutions associated with the first constraint (CON1) and the second constraint (CON2).

9. A non-transitory computer readable medium embodied with a computer program comprising processor readable code to enable a processor to execute the method of claim 1, the processor readable code comprising:

code for defining three functions (F1, F2, F3) representing three of the N-primary color output components as a function of the remaining N-3 primary color output signal components;

code for substituting the values of the primary color input components into the three functions to determine unknown coefficients of the three functions; and code for determining optimal values of the N-primary color output signal by applying the constraint to the three functions.

10. The non-transitory computer readable medium as claimed in claim 9, wherein the computer readable medium is a software plug-in in an image processing application.

11. A system for redistributing a N-primary color input signal (IS) having N input components into a N-primary color output signal having N output components (P1, . . . , PN) under a constraint, the system comprises:

means for defining three functions (F1, F2, F3) representing (i) three of the N-primary color output components as a function of (ii) the remaining N-3 primary color output signal components, wherein the defining means comprises a multi-primary redistribution conversion unit, and wherein the functions (F1, F2, F3) define ranges of possible values of three input components of the N-primary color input signal;

means for substituting the values of the N primary color input components into the three functions to determine unknown coefficients of the three functions, wherein said substituting means comprises the multi-primary redistribution unit and a primary color parameter unit; and means for determining optimal values of the N output components of the N-primary color output signal by (a) applying the constraint to the three functions, wherein the constraint comprises (a)(i) an equal luminance drive constraint or (a)(ii) a minimum/maximum drive constraint, wherein the equal luminance drive constraint determines selection of drive values of the N output components (a)(i)(1) defined by a linear combination of a first subset of the N output components that represents luminance of the first subset of output components and by a linear combination of a second subset of the N output components that represents luminance of the second subset of output components, and (a)(i)(2) subtraction of the linear combination of the second subset from the first subset is zero, wherein the minimum/maximum drive constraint determines selection of drive values of the N output components for which (a)(ii)(1) a maximum drive value is a minimal value or (a)(ii)(2) a minimum drive value is a maximum value, and (b) selecting an optimal value for each respective output component within a valid range (VS) which fits the equal luminance or minimum/maximum drive constraint, wherein the valid range (VS) comprises a common range of a respective N-3 output component (P4, . . . , PN) for which all three functions (F1, F2, F3) have values which are in the common range, and wherein the optimal values of the N output components (P1, . . . , PN) are (i) determined in a single step, or (ii) first the optimal values of the N-3 output components (P4, . . . , PN) are determined and then, using the optimal values of the N-3 output components (P4, . . . , PN) in the three functions (F1, F2, F3), the optimal values of the three output components are determined, wherein the determining means comprises the multi-primary redistribution conversion unit and a constraint unit.

12. A display apparatus comprising the system of claim 11, a signal processor for receiving an input signal representing an image to be displayed to supply the N input components (I1, . . . , IN) to the system, and a display device for supplying the N output components (P1, . . . , PN) to sub-pixels of the display device.

13. A camera comprising the system of claim 11, and an image sensor supplying the N-primary color input signal (IS).

14. A portable device comprising the display apparatus of claim 12.

* * * * *